US006196203B1

(12) United States Patent
Grieve et al.

(10) Patent No.: US 6,196,203 B1
(45) Date of Patent: Mar. 6, 2001

(54) EVAPORATIVE EMISSION CONTROL SYSTEM WITH REDUCED RUNNING LOSSES

(75) Inventors: Malcolm James Grieve, Fairport, NY (US); Edward George Himes, Novi; Ningsheng Qiao, Troy, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/264,561

(22) Filed: Mar. 8, 1999

(51) Int. Cl.[7] ..... F02M 33/02
(52) U.S. Cl. ..... 123/520; 123/198 D
(58) Field of Search ..... 123/520, 198 D, 123/516, 518, 519

(56) References Cited

U.S. PATENT DOCUMENTS

| | | | | |
|---|---|---|---|---|
| 4,748,959 | | 6/1988 | Cook et al. | 123/520 |
| 5,094,213 | | 3/1992 | Dudek et al. | 123/478 |
| 5,146,902 | * | 9/1992 | Cook et al. | 123/518 |
| 5,263,462 | * | 5/1993 | Reddy | 123/520 |
| 5,297,529 | * | 3/1994 | Cook et al. | 123/520 |
| 5,343,760 | | 9/1994 | Sultan et al. | 73/861.04 |
| 5,411,004 | * | 5/1995 | Busato et al. | 123/520 |
| 5,437,257 | * | 8/1995 | Giacomazzi et al. | 123/520 |
| 5,596,972 | | 1/1997 | Sultan et al. | 123/520 |
| 5,753,805 | | 5/1998 | Maloney | 75/118.2 |
| 5,845,627 | | 12/1998 | Olin et al. | 123/676 |

* cited by examiner

*Primary Examiner*—Noah P. Kamen
*Assistant Examiner*—Mahmoud M Gimie
(74) *Attorney, Agent, or Firm*—Vincent A. Cichosz

(57) ABSTRACT

An evaporative emission control system that operates in a running loss mode and an active weathering mode during purge to substantially eliminate running losses during operation of an internal combustion engine. The evaporative emission control system includes a charcoal canister, a canister vent valve, and a purge valve that permits fuel vapors from the canister and engine fuel tank to be purged into the engine's air intake manifold. The running loss mode operates to close the canister vent valve when the gas pressure within the fuel tank increases above a threshold. The vent valve is maintained closed until the fuel tank pressure drops below a lower limit. This prevents running losses by closing the vent when higher pressures are detected that cannot be reduced by purging under the current engine operating conditions. The active weathering mode cycles the canister vent valve open and closed when the volatility of the fuel is determined to be too high for the current ambient temperature. This cycling forces air changes within the fuel tank to accelerate the weathering of the volatile components in the fuel. Fuel volatility is estimated based on tank temperature and fuel vapor concentration. The maximum desired volatility is determined for the ambient temperature and the active weathering mode is begun when the estimated volatility exceeds the maximum desired volatility.

18 Claims, 6 Drawing Sheets

EVAPORATIVE EMISSION CONTROL SYSTEM WITH REDUCED RUNNING LOSSES

TECHNICAL FIELD

This invention relates generally to evaporative emissions control systems used in automobile fuel systems to reduce evaporative emissions and, in particular, to such systems which provide control over the amount of fuel vapor existing within the vehicle's fuel tank.

BACKGROUND OF THE INVENTION

The automotive industry has had notable success in the reduction of regulated gaseous emissions from the use of hydrocarbon fuels in mass produced automobiles. For gasoline spark ignited engines, the gaseous emissions fall into two categories:

(1) evaporative emissions—which relate to unburned fuel vapors escaping from the vehicle's fuel tank, and (2) tailpipe emissions—which relate to emissions from the exhaust of the engine and include unburned and partially burned fuel, carbon monoxide, and oxides of nitrogen.

In the mid 1970s, catalytic converters and closed loop fuel control was adopted almost universally in the United States and progressively in other countries. As stricter emission control requirements were written into law, microprocessor-controlled fuel injection eventually became widespread, allowing for more elaborate and sophisticated control systems and fuel control strategies.

Early automotive control systems often used emulations of the mechanical controls that had been replaced by electronically-actuated devices. Simple physical and empirical strategies with primarily tabular calibrations were used in order to be compatible with the limited microprocessor capacity on-board the vehicle. Current state-of-the-art low emission systems utilize more advanced controls strategies that include mathematics and physics-based models of the complex chemical, thermodynamic, mechanical, and electrical processes that exist in the automobile. This modeling and control strategy is implemented using software which provides designers with a mix of advanced controls techniques and thrifty empiricism that they can use in providing efficient and effective engine control logic.

In state-of-the-art low emission gasoline vehicles, both evaporative emissions and tailpipe emissions have been reduced by more than 90% from previous uncontrolled levels. The reduction in evaporative emissions has been achieved largely by use of evaporative emission control systems that utilize a charcoal canister to store fuel vapors from the fuel tank, with periodic purging of the vapors into the air intake manifold of the engine where they are drawn into the engine cylinders and burned. However, the objective of further reducing the emissions to near zero levels gives rise to a conflict between the need for aggressive purging of the charcoal canister to control evaporative emissions and extremely precise control of engine Air/Fuel ratio for tailpipe emissions control. For example, the design of high pressure fuel injection systems has often included the use of high-flow re-circulation of fuel (pumped from the fuel tank to the engine and back to the tank). This would allow the fuel injectors to be maintained at lower operating temperatures, even in applications where underhood temperatures and fuel injector location would otheirwise have resulted in excessive fuel injector temperatures. This has helped avoid phenomena such as vapor lock and is also considered desirable for the longevity and precision of the fuel injector. However, this fuel control approach is at odds with the need to keep tank temperatures low to avoid evaporative running losses in extreme conditions. In addition, new requirements for On-Board Refueling Vapor Recovery (ORVR), On-board Diagnostic (OBD II and EOBD) and real-time and high temperature evaporative emission testing have created a strong need to more capable purge strategies.

One problem with currently available evaporative emission control systems is that they do not always prevent running losses; that is, loss of fuel vapors through the canister vent valve that is connected between the charcoal canister and the surrounding atmosphere. These running losses typically occur under conditions in which there is a large degree of fuel evaporation that cannot be purged at a high enough rate due to the current engine operating conditions. For example, in hot weather with the engine idling, the evaporation rate within the fuel tank may be greater than the current purge capacity of the engine, since it is running at idle. In both of these circumstances, pressure within the fuel tank due to the evaporating fuel, may actually force fuel vapors through the canister and out to the atmosphere through the canister vent valve. This problem is exacerbated by the use of high volatility fuels.

In response to the potentially high running losses that can occur with volatile gasoline blends in extreme temperature conditions, California has been the first to introduce legislation demanding reformulation requirements that include a mandate for special low volatility fuel. While this has served to drive the content of butane in California gasoline to lower levels, higher volatility fuel is still available in other states and countries. Moreover, as is known, the volatility of fuel is typically varied seasonally, with the higher volatility fuel being distributed and used during the winter months. Each spring there is normally a regionally applied cut-off date for the production and distribution of volatile winter grade fuel. Unseasonably warm weather or delays in selling and consuming this fuel can cause high volatility fuel to be present in vehicles operating in high temperature conditions. Also, the use of alcohol blends has been encouraged to achieve potentially lower tailpipe emissions. However, alcohol gasoline blends tend to be very volatile in extreme temperature conditions (even when the low temperature volatility is similar to normal commercial gasoline).

Similar issues exist in many hot climate countries around the world. Notable air quality improvements may be achieved in crowded urban markets by the development of emission control systems that can be more tolerant of volatile fuels in hot weather conditions. Improved control systems could reduce the need for fuel reformulation and enforcement of same and thus avoid costs to the oil industry and thus, indirectly, to the consumer.

One historical approach to address the problem of excessive vaporization of gasoline in the fuel tank has been the use of tank pressure control valves (TPCV). These were installed between the fuel tank and the charcoal canister in order to allow tank pressure to be above atmospheric temperature during potential evaporative emission conditions. While this hardware was relatively inexpensive and usefull in reducing evaporative emissions in some conditions, it had certain undesirable effects that has resulted in its used being discouraged by governmental regulators. Firstly, in refueling events a puff of evaporative emissions could result when the fuel tank temperature was hot and under some differential pressure. The so-called puff losses were lower than the potential evaporative emissions that might have otherwise occurred during an entire trip but the rapid loss of vapor in the presence of the vehicle operator during refueling was very undesirable. Secondly, in failure modes (where a pinhole leak existed in the fuel tank or associated hoses and connections) the TPCV prevented escaping vapors from being passed through the charcoal canister and thus resulted in dramatically increased evaporative emissions—similar to those of a vehicle without any evaporative emission control system. As a result of these problems, the use of TPCVs has largely been abandoned. Accordingly, there exists a continuing need for an evaporative emission control system that can reduce if not eliminate running losses.

SUMMARY OF THE INVENTION

In accordance with the present invention, there is provided an evaporative emission control system method and apparatus which helps prevent running losses. The control system includes a charcoal canister, purge valve, canister vent valve, a fuel tank temperature sensor, fuel tank pressure sensor, and an electronic control module that controls the purge and canister vent valves in response to data and inputs from the sensors. The canister is connected to receive evaporated fuel from a fuel tank. The purge valve is used to supply fuel vapors from the canister and fuel tank to an air intake manifold of an internal combustion engine that operates on fuel stored in the fuel tank. The canister vent valve is used to provide a source of fresh air into the system during purging of the canister.

The system includes a running loss mode which provides control of the canister vent valve to reduce evaporative emissions. The running loss mode process includes the steps of monitoring gas pressure within the fuel tank, closing the canister vent valve when the pressure within the fuel tank exceeds a threshold, and opening the canister vent valve when the pressure within the tank falls below a lower limit. The running loss mode operates to prevent running losses by closing the canister vent valve when higher pressures are detected in the tank that cannot be reduced by purging under the current engine operating conditions. This prevents emissions through the canister vent valve that could otherwise occur due to the higher pressures within the tank and also operates to suppress additional vapor generation within the tank. Once the engine operation conditions have changed such that purging brings the pressure in the tank to below a lower limit, the running loss mode is exited and the normal purge mode continues.

The system also includes an active weathering mode which operates to cycle the canister vent valve open and closed when the volatility of the fuel is determined to be too high for the current ambient temperatures. This cycling of the vent valve helps purge the fuel vapors from the tank, replacing them with fresh air drawn in by the vacuum created in the tank while the canister vent valve was closed. Fuel volatility is estimated based upon tank temperature and tank fuel vapor concentration. The maximum desired fuel volatility is determined for the ambient temperature and, if it is less than the estimated volatility, the active weathering process begins. Once the volatility falls below the desired maximum volatility, the active weathering mode process ends.

BRIEF DESCRIPTION OF THE DRAWINGS

A preferred exemplary embodiment of the present invention will hereinafter be described in conjunction with the appended drawings, wherein like designations denote like elements, and.

DESCRIPTION OF THE PREFERRED EMBODIMENT

Figure 1:
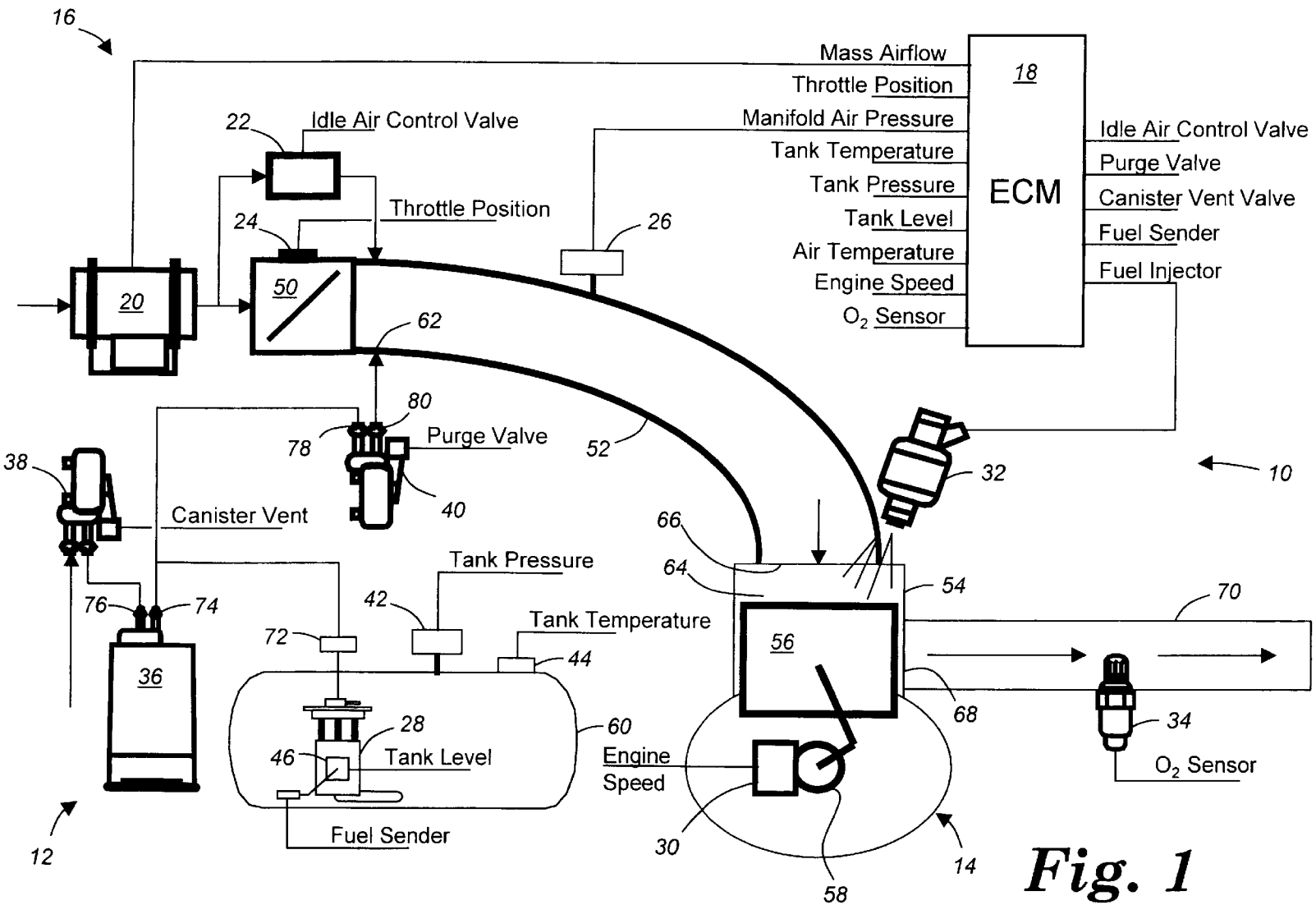
FIG. 1 is a diagrammatic view of a preferred exemplary embodiment of the invention, showing a fuel injection system and evaporative emission control system that are integrated together into a single fuel control system for an automotive internal combustion engine.

Referring to FIG. 1, there is shown a fuel injection system 10 and evaporative emission control system (EECS) 12 for an internal combustion engine 14. While fuel injection system 10 and EECS 12 can be implemented separately, in the preferred embodiment shown in FIG. 1 they are integrated together into a single fuel control system 16. In general, EECS 12 manages evaporative emissions from the stored fuel that is used to operate engine 14 and provides the vaporized fuel to engine 14 when necessary. Fuel injection system 10 determines the amount of fuel to be injected each engine cycle, taking into account any fuel vapors provided by EECS 12. In this way, evaporative emissions from the stored fuel can be used in engine operation, rather than being lost to the environment, and can be accounted for in the fuel calculations so that the engine 14 can be operated in a manner that minimizes exhaust emissions.

Fuel injection system 10 includes an electronic control module (ECM) 18, a mass airflow meter 20, idle air control valve 22, throttle position sensor 24, manifold absolute pressure (MAP) sensor 26, fuel sender 28, engine speed sensor 30, solenoid-operated fuel injector 32, and exhaust gas oxygen ($O_2$) sensor 34. EECS 12 includes ECM 18 as well as a charcoal canister 36, canister vent valve 38, purge valve 40, fuel tank pressure sensor 42, fuel tank temperature sensor 44, and a tank level sensor 46 that can be a part of fuel sender 28. The components of fuel injection system 10 and EECS 12 all form a part of fuel control system 16 and these components can be conventional parts connected together in a manner that is well known to those skilled in the art. As will be appreciated, fuel control system 16 may also include a number of other components known to those skilled in the art that can be used in a conventional manner to determine the quantity of fuel to be injected each cycle. Such components can include, for example, an engine temperature sensor and an air temperature sensor incorporated into or located near the airflow meter 20, neither of which is shown in FIG. 1.

ECM 18 contains the software programming necessary for implementing the evaporative emissions control, fuel quantity calculations, and fuel injection control provided by fuel control system 16. As will be known to those skilled in the art, ECM 18 is a microprocessor-based controller having random access and read-only memory, as well as non-volatile re-writable memory for storing data that must be maintained in the absence of power. ECM 18 includes a control program stored in ROM that is executed each time the vehicle is started to control fuel delivery to the engine. ECM 18 also includes suitable analog to digital converters for digitizing analog signals received from the various sensors, as well as digital to analog converters and drivers for changing digital command signals into analog control signals suitable for operating the various actuators shown in FIG. 1. ECM 18 is connected to receive inputs from airflow meter 20, throttle position sensor 24, MAP sensor 26, engine speed sensor 30, $O_2$ sensor 34, tank pressure sensor 42, tank temperature sensor 44, and tank level sensor 46. ECM 18 is connected to provide actuating outputs to idle air control valve 22, fuel sender 28, fuel injector 32, canister vent valve 38, and purge valve 40.

The components of engine 14 relevant to fuel control system 16 include an engine throttle 50, intake manifold 52, a number of cylinders 54 and pistons 56 (only one of each shown), and a crankshaft 58 for creating reciprocal motion of the piston within cylinder 54. Throttle 50 is a mechanical throttle that is connected downstream of airflow meter 20 at the entrance of intake manifold 52. Throttle 50 is controlled by the vehicle operator and its position sensor 24 is used to provide ECM 18 with a signal indicative of throttle position. Idle air control valve 22 provides a bypass around throttle 50, and it will be appreciated that an electronically-controlled throttle could be used in lieu of idle air control valve 22 and mechanical throttle 50. Purge valve 40 feeds purge air from charcoal canister 36 and/or fuel tank 60 into the intake manifold at a purge port 62 that is located just downstream of the throttle. Thus, the intake air that flows through manifold 52 comprises the air supplied by idle air control valve 22, purge valve 40, and throttle 50. MAP sensor 26 is connected to intake manifold 52 to provide the ECM with a signal indicative of gas pressure within the intake manifold. In addition to determine appropriate fuel quantities, it can be used to provide a reading of the barometric pressure, for example, prior to engine cranking.

At the cylinder end of intake manifold 52, air flows into a combustion chamber 64, which is merely the space within cylinder 54 above piston 56. The intake air flows through a valve (not shown) at the intake port 66 of the cylinder and then into the combustion chamber. Fuel injector 32 can be placed in a conventional location upstream of the intake port 66 or within the cylinder head in the case of direct injection. After combustion, the exhaust exits the cylinder through a valve (not shown) at an exhaust port 68 and is carried by an exhaust pipe 70 past $O_2$ sensor 34 and to a catalytic converter (not shown). As will be appreciated by those skilled in the art, this $O_2$ sensor can either be a wide-range air/fuel sensor or a switching sensor.

As shown in FIG. 1, evaporative emissions from the fuel in tank 60 are fed by way of a rollover valve 72 to a first port 74 of charcoal canister 36. These vapors enter canister 36, displacing air which is vented via a second port 76 to the atmosphere by way of canister vent valve 38. Port 74 is also connected to an inlet 78 of purge valve 40. The outlet 80 of this purge valve is connected to purge port 62 on the intake manifold. This allows fuel vapors from canister 36 and tank 60 to be supplied to the intake manifold via the purge valve 40. Purging of the canister and fuel tank is controlled by ECM 18 which operates purge valve 40 periodically to permit the vacuum existing in intake manifold 52 to draw purge gas from canister 36 and tank 60. Purge valve 40 is a solenoid-operated valve, with ECM 18 provided a duty cycled controlled signal to regulate the flow rate of purge gas through valve 40. When the canister vent valve 38 is open during purging, fresh air is drawn into the canister via the vent valve and port 76, thereby allowing the fuel vapors to be drawn from the canister. When the canister vent valve is closed, the introduction of fresh air through port 76 is blocked, allowing fuel vapors to be drawn from the tank 60. This purge-on, vent-closed state is generally done for the purpose of diagnostics of the fuel tank 60 and EECS 12.

Figure 2:
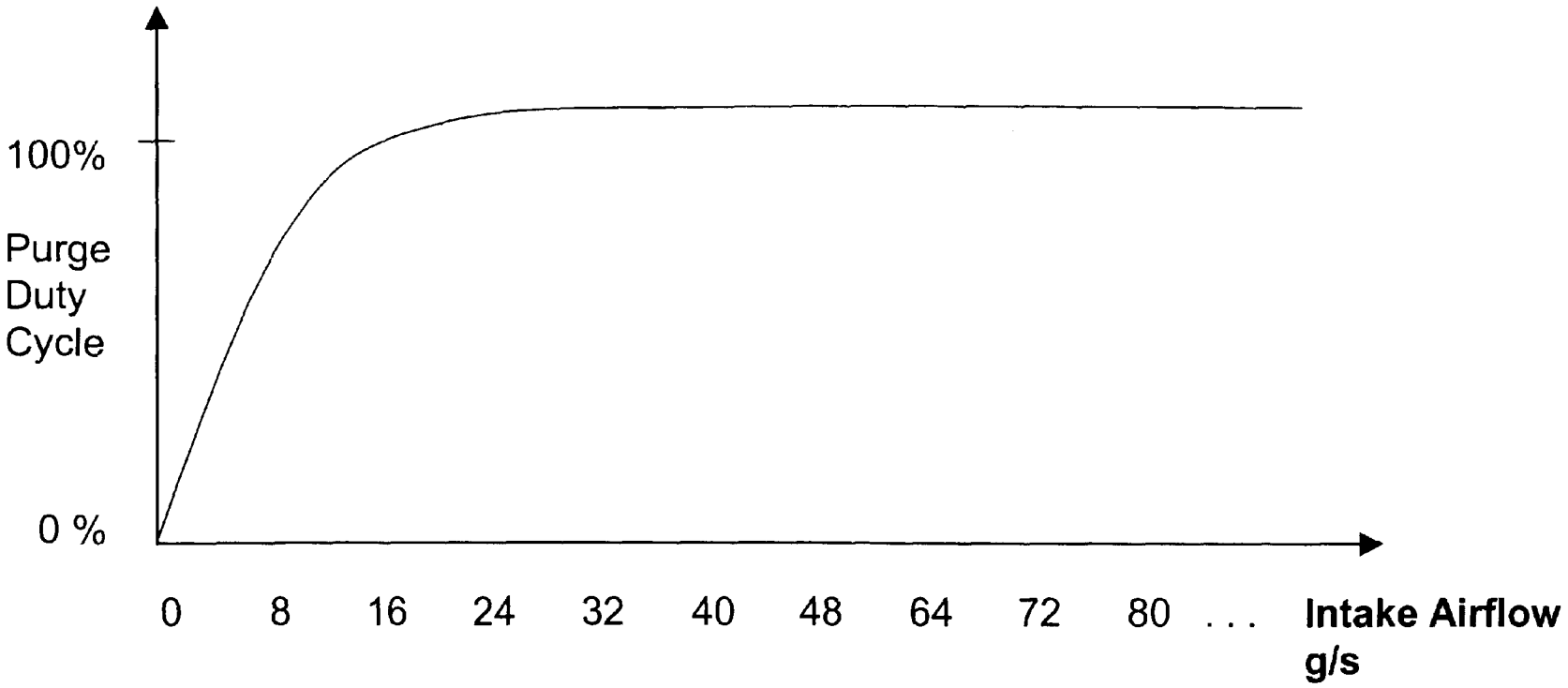
FIG. 2 is a graph depicting the purge valve duty cycle as a function of intake manifold airflow rate.

With reference now to FIG. 2, it can be seen that, at lower air intake flow rates (e.g., at idle), the maximum allowable duty cycle for the purge solenoid 40 is constrained to a low value to limit the amount of purge fuel vapors entering the engine. In engine fuel control systems which do not account for the purge fuel vapors in the fuel calculation, this prevents the error in total fuel delivered from becoming so large as to have a significant negative effect on emissions or driveability. However, this duty cycle limitation is used even in fuel control systems which do account for the amount of fuel contributed by the purge gas. This duty cycle limitation is still needed in these more advanced systems because the error in the purge fuel vapor estimates, while insignificant when the purge fuel vapors are a small percentage of the total fuel delivered, can become undesirably significant when the purge fuel vapors are a large percentage of the total fuel delivered.

Under certain conditions, the evaporation of fuel in tank 60 can cause the pressure to rise to the point at which there can be a loss of fuel vapors via the canister vent valve 38. This can occur, for example, where the fuel is of a sufficient temperature and volatility that it is evaporating at a greater rate than can be handled by purging. This occurs particularly on hot days in city driving where the engine may be idling much of the time. The hot temperatures result in increased evaporation and, as shown in FIG. 2, the slower engine speeds (and, therefore, lower intake airflow rates) result in lower purge rates. To prevent these running losses, EECS 12 includes a running loss mode in which it closes the canister vent valve until a later time at which the engine operating conditions are suitable for a sufficiently high purge rate. During normal purging of the system, EECS 12 enters this running loss mode when the pressure within the fuel tank exceeds a threshold pressure which can be, but need not be, above barometric pressure.

Figure 3:
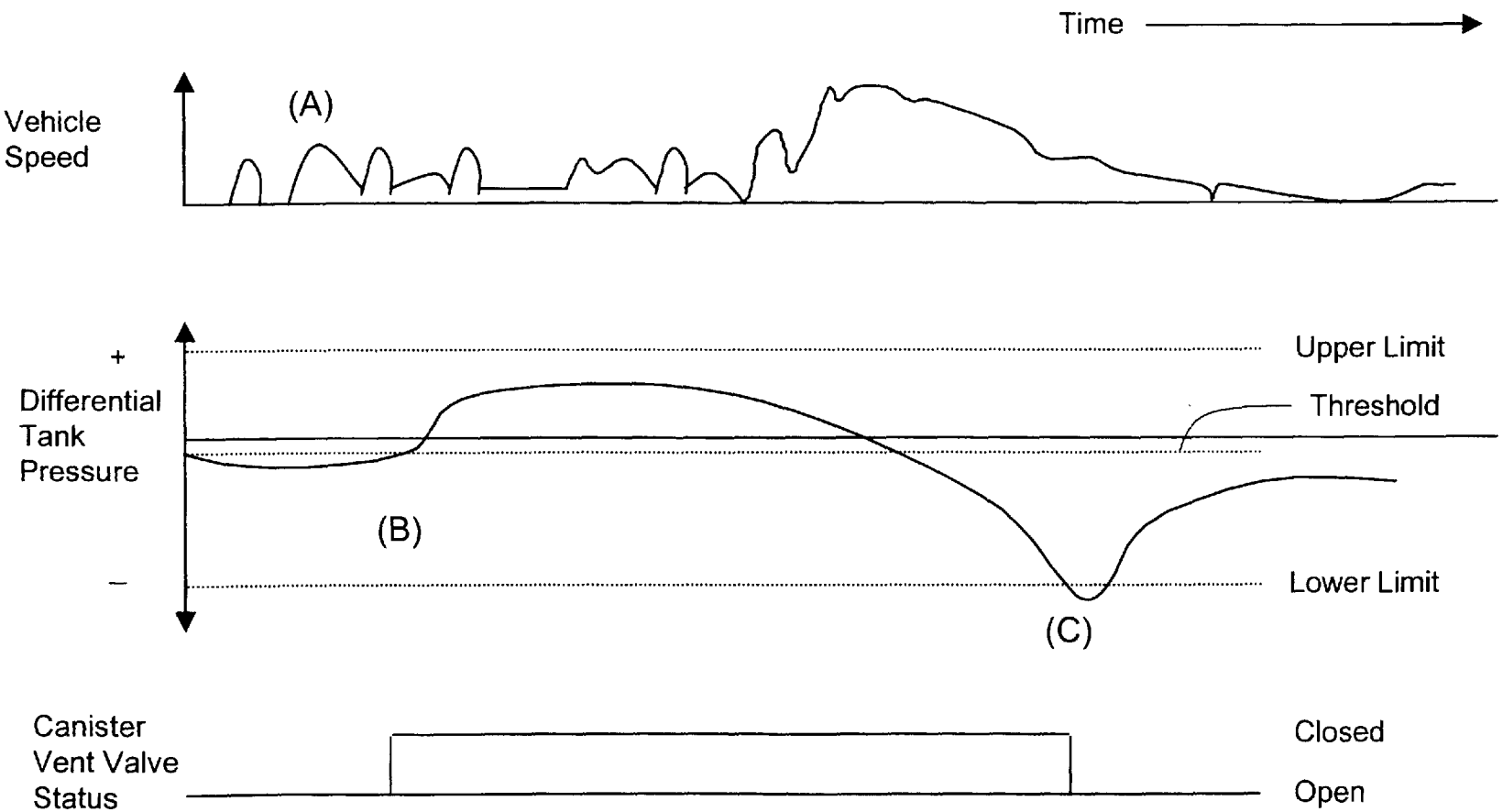
FIG. 3 is set of graphs showing the conditions under which the evaporative emissions system of FIG. 1 switches between normal purge mode and running loss mode.

This triggering of the running loss mode is shown in FIG. 3. The top graph depicts vehicle speed as a function of time and is provided simply for the purpose of describing the operation of EECS 12 in the running loss mode. The middle graph depicts the tank pressure along with the threshold and upper and lower limits that are used during the running loss mode. The lower graph shows the switching of the normally open canister vent valve between its open and closed positions. During the low speed driving indicated at (A), the fuel tank pressure begins to build and at point (B) exceeds the threshold which in this example, is slight below barometric pressure. In response to this excursion above the threshold, ECM 18 checks various enable criteria, including, for example, whether the canister has been purged or whether EECS diagnostics are in progress. If the enable criteria are met, ECM 18 closes the canister vent valve 38. This valve is maintained in its closed state until point (C) where the purge rate has increased sufficiently to draw the tank pressure back down to below the lower limit. Preferably, this lower limit represents a vacuum condition, as shown, although it will be appreciated that it can be any value below the threshold and can even be same as the threshold, if desired.

In the illustrated embodiment, tank pressure sensor 42 is used by EECS not only for monitoring tank pressure to determine when to enter the running loss mode, but also to perform diagnostic leak testing of the charcoal canister and fuel tank. To avoid operation of the running loss mode at positive pressures near or at the measurement limit of the pressure sensor 42, an upper limit can also be provided with ECM 18 being programmed to exit the running loss mode when the tank pressure exceeds the upper limit.

In event that the normal diagnostic leak test determines that there is a leak in the system, the positive pressure that typically exists when operating in the running loss mode can actually increase evaporative emissions by forcing fuel or fuel vapors out through the leak. This is one of the problems that can be caused by evaporative emission control systems that utilize tank pressure control valves. However, since the canister vent valve is controlled by ECM 18, then in the presence of a leak the system can enter into a second mode of operation in which the canister vent valve is maintained in an open condition with the running loss mode being disabled. Alternatively, the threshold, if above barometric pressure, can be reduced to barometric pressure or to a value somewhat below barometric pressure and if desired, the upper limit can be reduced to a value near barometric pressure. This would allow the system to utilize the running loss mode without creating any positive pressure that would otherwise result in evaporative emissions.

Another disadvantage of tank pressure control valve designs is that the positive pressure created in the fuel tank can cause puff losses when the tank is opened for refueling. In the illustrated embodiment, this is avoided by ECM 18 opening the canister vent valve when the ignition is turned off. This allows the pressure within the tank to vent to atmosphere through the charcoal canister where the fuel vapors can be trapped. As will be appreciated by those skilled in the art, in addition to preventing evaporative emissions, the running loss mode suppresses the generation of additional fuel vapors within the tank in the same manner as prior art tank pressure control valves; namely, that as the pressure in the tank increases due to the closed vent valve, the evaporation (boiling) point increases, thereby decreasing the amount of evaporation. Thus, the running loss mode provides the benefits of a tank pressure control valve without the concomitant leak and puff losses.

In addition to the benefits provided by the running loss mode, a further improvement in evaporative emission control can be achieved using a proactive approach to fuel tank vapor management. This is achieved by an active weathering mode of operation in which EECS 12 monitors a variety of fuel tank parameters and cycles the canister vent valve closed and open one or more times upon detecting that high fuel volatility conditions exist. This cycling of the canister vent valve purges the tank fuel vapors when the valve is closed and allows fresh air back into the tank when the valve re-opens. This actively weathers the fuel before runaway vapor generation (boiling in the tank) can begin by forcing air changes in the vapor space within the tank.

Figure 4:
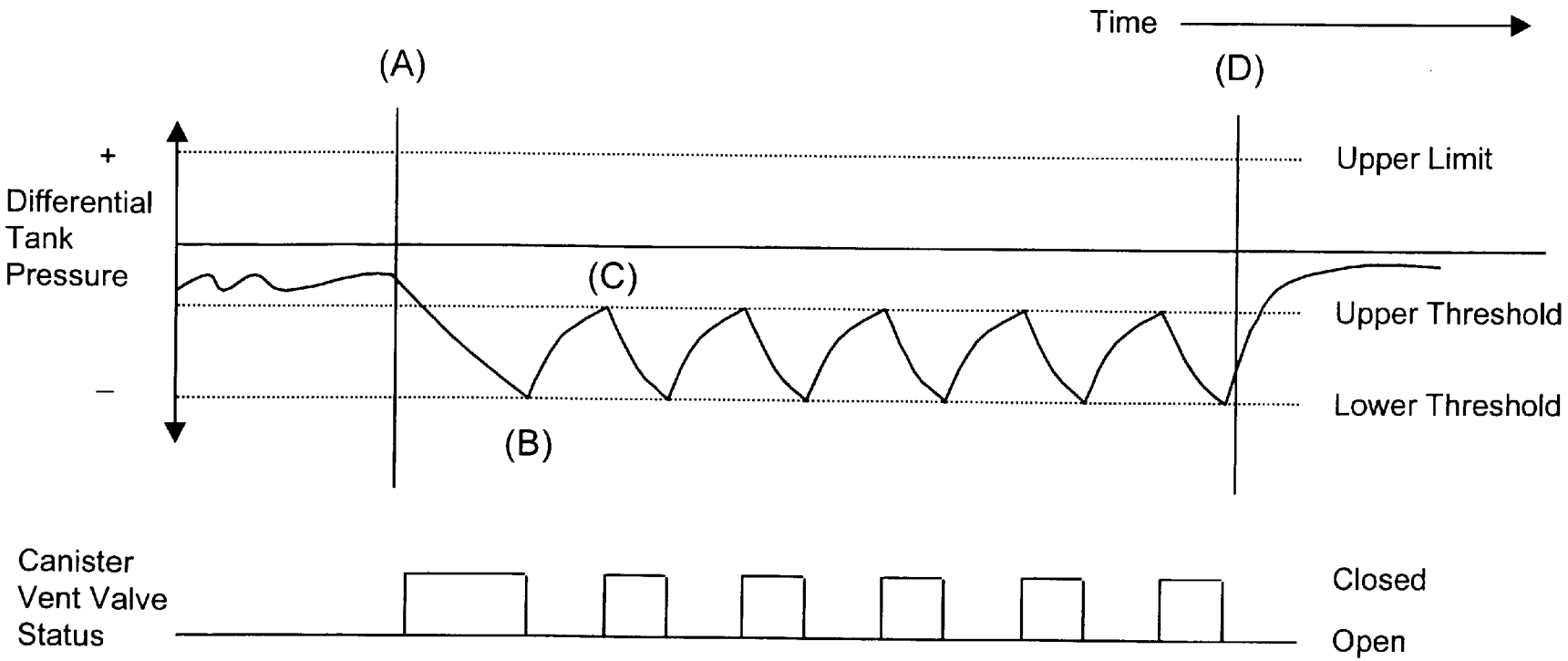
FIG. 4 is set of exemplary graphs showing the cycling of the canister vent valve and the pressure variation within the fuel tank due to operation of the evaporative emission control system of FIG. 1 in the active weathering mode.

Turning now to FIG. 4, there is shown a pair of exemplary graphs depicting the active weathering process. The upper graph depicts the variation in tank pressure resulting from cycling of the canister vent valve during purge. The lower graph shows the state of the vent valve itself. The active weathering process operates as follows. ECM 18 estimates the fuel volatility for the current ambient conditions in a manner that will be described in greater detail below. If the estimated fuel volatility is determined to be too high the active weathering mode is triggered, as indicated at point (A). In this mode the canister vent valve 38 is cycled between its closed and open positions while purge valve 40 is on. This mode begins at (B) by closing the canister vent valve which purges fuel vapors within the tank. When the pressure drops below a lower threshold at (C), the canister vent valve is opened. Although purge continues, the vacuum level in the tank is sufficient to reverse the flow of gas through the rollover valve 72. This brings fresh air into the tank through the charcoal canister 36 (which is kept clean by this periodic backflow). The dilution of the vapors in the tank by this fresh air stimulates the evaporation of additional fuel vapors during the next cycle. This process continues until ECM 18 determines that the concentration of fuel vapors in the tank is low enough that the estimated fuel volatility is suitable for the ambient temperature range. Thereafter, the active weathering mode is exited at (D) and the tank pressure returns to normal near atmospheric pressure while normal purge continues.

Figure 5:
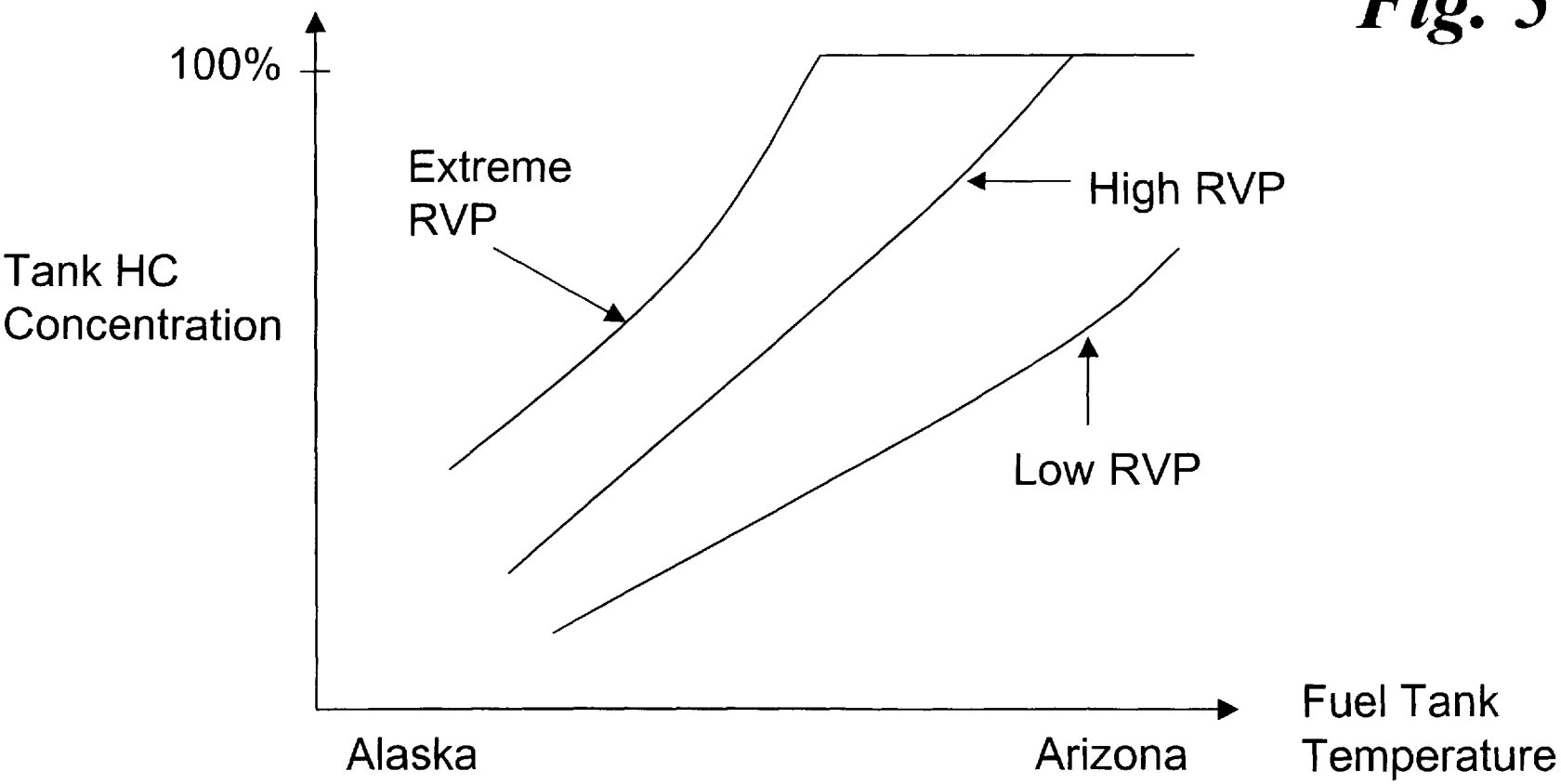
FIG. 5 is a graph depicting the relationship of tank hydrocarbon concentration versus fuel tank temperature for various grades of fuel volatility.

In the illustrated embodiment, an estimate of the fuel volatility and ambient temperature are used to determine whether conditions are appropriate for active weathering. As shown in FIG. 5, for any particular fuel tank temperature, the concentration of fuel vapors, or hydrocarbon concentration [HC], depends upon the volatility of the fuel present. The volatility can be measured or expressed in units of Reed Vapor Pressure (RVP). In cold winter climes, fuel having an extreme RVP is used. However, if such fuel is used in summer conditions (i.e., at high tank temperatures), the fuel may boil until it is sufficiently weathered; that is, until the light constituents have been boiled away. The relationship between tank temperature, tank [HC] concentration, and fuel volatility is used to estimate the fuel volatility. More specifically, fuel volatility is estimated by measuring the tank temperature using temperature sensor 44, measuring or otherwise estimating [HC], and then estimating the volatility using the relationship shown in FIG. 5. This relationship can be provided by way of an equation or look-up table stored in memory, with the tank temperature and [HC] being used together to obtain the associated volatility value by either computation or look-up. The hydrocarbon concentration [HC] can be measured using a physical sensor, as taught in U.S. Pat. No. 5,343,760 and utilized in U.S. Pat. No. 5,596,972, and the entire contents of these two patents are hereby incorporated by reference. Alternatively, [HC] can be estimated, as discussed in the U.S. patent application filed in the name of the same inventors on an even date herewith and entitled "Fuel Control System with Purge Gas Modeling and Integration," the entire contents of which are also hereby incorporated by reference.

Once a data value representing the fuel volatility has been determined, the ambient temperature is measured or estimated and is used to determine a maximum desired volatility which is then compared to the estimated actual fuel volatility. If the estimated volatility exceeds the maximum desired volatility, and if the enable criteria discussed above in connection with the running loss mode are met, then the active weathering process begins. The ambient temperature can be measured directory using a thermistor or other temperature sensor, or can be estimated in any of a number of manners well known to those skilled in the art. Moreover, if desired the ambient temperature used can be an average of a number of temperature values.

Figure 6:
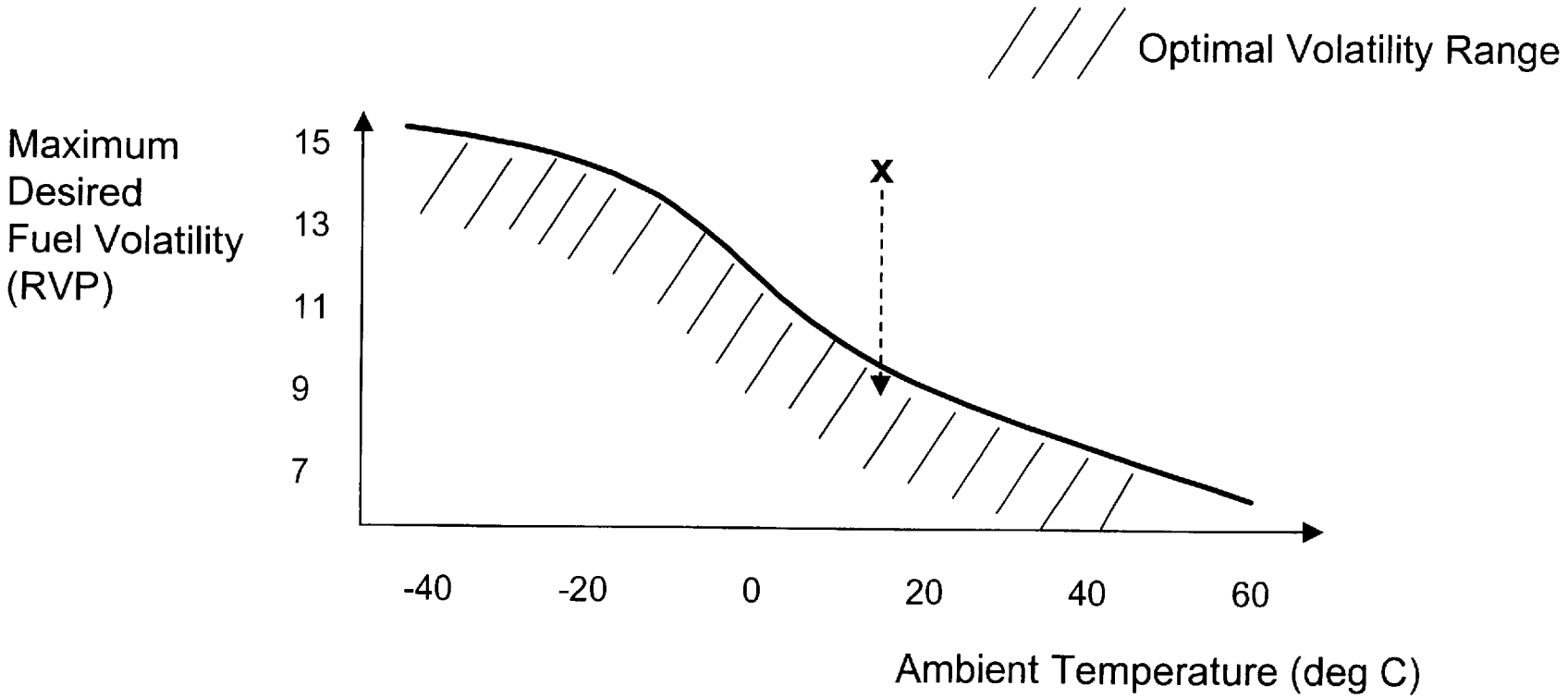
FIG. 6 is a graph depicting a volatility threshold as a function of ambient temperature which is used by the evaporative emissions system of FIG. 1 in determining whether to switch into or out of the active weathering mode.

An exemplary graph depicting the maximum desired volatility as a function of ambient temperature is shown in FIG. 6. This relationship can be implemented as an equation or look-up table. As depicted in FIG. 6, if the estimated volatility is greater than the desired maximum for a particular temperature, as indicated at point X, then active weathering begins and is carried out until the volatility has been determined to have fallen below the desired maximum.

It will thus be apparent that there has been provided in accordance with the present invention an evaporative emission control system which achieves the aims and advantages specified herein. It will of course be understood that the foregoing description is of a preferred exemplary embodiment of the invention and that the invention is not limited to the specific embodiment shown. Various changes and modifications will become apparent to those skilled in the art and all such variations and modifications are intended to come within the scope of the appended claims.

We claim:

1. A method of controlling a canister vent valve used in an evaporative emissions control system to reduce running losses during purging of fuel vapors from a charcoal canister to an air intake of an internal combustion engine, wherein the control system includes a purge valve connected between the canister and air intake, with the canister being connected to receive evaporated fuel from a fuel tank that is used to supply fuel to the engine, the method comprising the steps of:

monitoring gas pressure within the fuel tank, closing the canister vent valve while the engine is operating and the purge valve is open when the pressure within the fuel tank exceeds a threshold, and opening the canister vent valve while the engine is operating and the purge valve is open when the pressure within the tank falls below a lower limit, whereby the canister vent valve can be held closed during purging until the pressure within the fuel tank drops to below the lower limit.

2. The method of claim 1, wherein the evaporative emissions control system has plural modes of operation with said closing and opening steps being carried out when the evaporative emissions control system is in a first one of its modes of operation, wherein the method further comprises the steps of:

periodically performing a leak diagnostic test of the charcoal canister and fuel tank, and in response to determining that a leak exists, entering into a second mode of operation in which said canister vent valve is maintained in an open position.

3. The method of claim 1, wherein said threshold is greater than barometric pressure.

4. The method of claim 3, wherein the evaporative emissions control system has plural modes of operation with said closing and opening steps being carried out when the evaporative emissions control system is in a first one of its modes of operation, wherein the method further comprises the steps of:

periodically performing a leak diagnostic test of the charcoal canister and fuel tank, and in response to determining that a leak exists, decreasing said threshold to a value below barometric pressure.

5. The method of claim 1, further comprising the steps of determining the pressure within the fuel tank using a pressure sensor and periodically performing a leak diagnostic test of the charcoal canister and fuel tank using said pressure sensor.

6. The method of claim 1, further comprising the steps of placing the canister vent valve in an open condition in response to shutdown of the engine, whereby pressure within the fuel tank will be relieved via the charcoal canister and canister vent valve.

7. The method of claim 1, wherein said opening step further comprises opening the canister vent valve if the pressure within the tank exceeds an upper limit.

8. The method of claim 1, wherein said steps are carried out when the evaporative emission control system is in a first mode and wherein the control system has a second mode of operation that comprises the following steps:

switching the canister vent valve to a closed condition, monitoring gas pressure within the fuel tank, opening the canister vent valve when the pressure is falls below a lower threshold, and closing the canister vent valve when the pressure exceeds an upper threshold.

9. The method of claim 8, wherein said first mode comprises a running loss mode and the second mode comprises an active weathering mode.

10. A method of controlling the quantity of fuel vapors in a fuel tank using an evaporative emissions control system that includes a charcoal canister for receiving fuel vapors from the tank, a purge valve that permits purging of the fuel vapors, and a canister vent valve that permits atmospheric air to flow into the canister, the method comprising the steps of:

obtaining a first data value that is related to the temperature of fuel within the fuel tank, obtaining a second data value that is related to the concentration of fuel vapors within the tank, determining a third data value using said first and second data values, wherein said third data value is indicative of the volatility of the fuel within the fuel tank, obtaining a fourth data value that is related to the temperature of ambient air, determining a threshold using said fourth data value, and closing the canister vent valve if the third data value exceeds said threshold.

11. The method of claim 10, further comprising the step of obtaining a fifth data value that relates to the gas pressure within the fuel tank, wherein said step of determining a third data value further comprises determining said third data value using said first, second, and fifth data values.

12. The method of claim 10, wherein said closing step further comprises cycling the canister vent valve between a closed position and open position to thereby reduce the temperature and concentration of fuel vapors within the fuel tank.

13. The method of claim 12, wherein said cycling step further comprises obtaining a fifth data value that is related to pressure within the fuel tank, switching the canister vent valve to an open condition when the fifth data value is less than or equal to a lower threshold and thereafter switching the canister vent valve to a closed condition when the fifth data value is greater than or equal to an upper threshold.

14. The method of claim 13, further comprising the step of repeating said switching steps until the concentration of fuel vapors within the fuel tank falls below a selected value.

15. The method of claim 10, wherein said third data value is determined using a lookup table.

16. The method of claim 10, wherein said threshold is indicative of a maximum desired volatility and is determined using a lookup table and said fourth data value.

17. A method of controlling the quantity of fuel vapors in a fuel tank using an evaporative emissions control system that includes a charcoal canister for receiving fuel vapors from the tank, a purge valve that permits purging of the fuel vapors, and a canister vent valve that permits atmospheric air to flow into the canister, the method comprising the steps of:

switching the canister vent valve to a closed condition, monitoring gas pressure within the fuel tank, opening the canister vent valve while the engine is operating and the purge valve is open when the pressure falls below a lower threshold, and closing the canister vent valve while the engine is operating and the purge valve is open when the pressure exceeds an upper threshold, wherein the upper threshold is above the lower threshold.

18. The method of claim 17, wherein said opening and closing steps further comprise cycling the canister vent valve multiple times between an open and closed position to thereby reduce the temperature and concentration of fuel vapors within the fuel tank, whereby said steps comprise an active weathering mode of operation.

* * * * *